US008029305B2

(12) United States Patent
Tanaka

(10) Patent No.: US 8,029,305 B2
(45) Date of Patent: Oct. 4, 2011

(54) CONNECTOR MOUNTING STRUCTURE, CONNECTOR, A GROMMET AND MOUNTING METHOD

(75) Inventor: Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/622,723

(22) Filed: Nov. 20, 2009

(65) Prior Publication Data

US 2010/0130050 A1 May 27, 2010

(30) Foreign Application Priority Data

Nov. 26, 2008 (JP) ..... 2008-300543

(51) Int. Cl.
*H01R 4/50* (2006.01)

(52) U.S. Cl. ..... 439/345

(58) Field of Classification Search ..... 439/345, 439/556, 552, 559, 34, 567, 271
See application file for complete search history.

(56) References Cited

U.S. PATENT DOCUMENTS 6,835,094 B2 * 12/2004 Matsushita ..... 439/559
6,840,789 B2 1/2005 Shibata

* cited by examiner

*Primary Examiner* — Alexander Gilman
(74) *Attorney, Agent, or Firm* — Gerald E. Hespos; Michael J. Porco

(57) ABSTRACT

Connection resistance (Rc) resulting from the resilient deformation of a lock arm (26) is produced in the process of connecting two housings (10, 20), and connection resistance (Rb) resulting from a resilient restoring force of a grommet (30) held in contact with a panel (P) is produced with the two housings (10, 20) properly connected. In the process of connecting the two housings (10, 20), the connection resistance (Rb) resulting from the resilient restoring force of the grommet (30) increases after the lock arm (26) is resiliently restored.

6 Claims, 5 Drawing Sheets

CONNECTOR MOUNTING STRUCTURE, CONNECTOR, A GROMMET AND MOUNTING METHOD

BACKGROUND OF THE INVENTION

1. Field of the Invention

The invention relates to a connector mounting structure.

2. Description of the Related Art

A known panel-mountable connector has a fixed housing mounted in a mount hole of a panel, a movable housing to be connected with the fixed housing and a waterproof grommet attached to the movable housing.

A lock arm formed in one housing interferes with a lock in the other housing and resiliently deforms in the process of connecting the two housings. A resilient restoring force of the lock arm causes a frictional force and produces a connection resistance. The lock arm resiliently restores when the two housings reach a properly connected state and engages the lock to hold the two housings together.

The grommet is held resiliently in contact with the panel around an opening area of the mount hole to display its waterproof function when the two housings are connected properly. Thus, connection resistance resulting from a resilient restoring force of the grommet is produced in the process of connecting the two housings in addition to the connection resistance resulting from the lock arm.

The connector may be structured so that the connection resistance resulting from the resilient restoring force of the grommet suddenly increases before the lock arm is restored resiliently to engage the lock. If a connecting operation is performed slowly, an operator may misjudge that the two housings have reached the properly connected state when the connection resistance resulting from the resilient restoring force of the grommet suddenly increases. In this case, there is a possibility that the operator finishes the connecting operation before the lock arm is restored resiliently to effect locking.

The present applicant proposed a connector disclosed in U.S. Pat. No. 6,835,094 to solve this problem. This connector has an inertial locking structure for assuring a proper connecting operation. According to this structure, while the two housings are being connected, the lock arm collides with the lock to increase the connection resistance temporarily, thereby controlling the connecting operation.

If an operation force exceeding this connection resistance is given to the two housings, the lock arm is deformed resiliently to disengage from the lock. Thus, the connecting operation proceeds in a single a stroke. While the connecting operation proceeds at a stroke, connection resistance resulting from the resilient deformation of the lock arm and resistance resulting from the resilient deformation of the grommet are produced. However, the connecting operation proceeds with a force exceeding these connection resistances and the two housings reliably are connected properly.

The inertial locking structure requires an operation of giving the operation force exceeding the connection resistance resulting from the collision of the lock arm and the lock, and this operation places a burden on the operator. Thus, if the number of connecting operations performed by the operator is small, the burden on the operator is small even if the inertial locking structure is employed. However, the burden on the operator can be large.

The present invention was developed in view of the above situation and an object thereof is to enable a connecting operation of two connector housings to be completed without placing a burden on an operator.

SUMMARY OF THE INVENTION

The invention relates to a mounting structure for mounting a connector to a panel. The connector includes a fixed housing to be mounted on the panel, a movable housing to be connected with the fixed housing while the fixed housing is mounted on the panel, and a grommet to be attached to the movable housing before the movable housing is connected with the fixed housing. A lock arm is formed in one of the housings and a lock is formed in the other housing. The lock arm engages the lock in the process of connecting the movable housing with the fixed housing. Thus, the lock arm deforms resiliently and produces a connection resistance due to a resilient restoring force of the lock arm. The lock arm resiliently restores and engages the lock when the fixed housing and the movable housing reach a properly connected state, thereby preventing the fixed housing and the movable housing from being separated from each other. The grommet is held resiliently in contact with the panel when the fixed and movable housings are connected properly. The grommet is formed so that connection resistance resulting from a resilient restoring force of the grommet held in contact with the panel increases after the lock arm is deformed resiliently in the process of connecting the movable housing with the fixed housing.

Terminal fittings are provided in the housings and preferably engage with each other only after the lock arm is being deformed so that no connection resistance resulting from the contact of the terminal fittings is produced before the lock arm is being deformed.

The lock arm preferably extends substantially parallel with a connecting direction of the housings when the lock arm is in a locking posture without being deformed.

The magnitude of the connection resistance resulting from the resilient restoring force of the grommet preferably is substantially constant during a period from immediately before the lock arm is restored resiliently until the lock arm is restored.

The connection resistance resulting from the resilient restoring force of the grommet preferably increases after the lock arm is restored resiliently to effect locking.

The invention also relates to a grommet for use with the above-described connector.

In the process of connecting the two housings, an operator feels an increase of connection resistance after the lock arm is restored resiliently to engage the lock. Thus, an operator will not misjudge that the housings have reached a properly connected state before the lock arm and the lock are engaged even if the connecting operation is performed slowly so as not to burden the operator. Therefore, the operator can complete the connecting operation until the lock arm is restored resiliently to effect locking and reliably connect the two housings properly.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
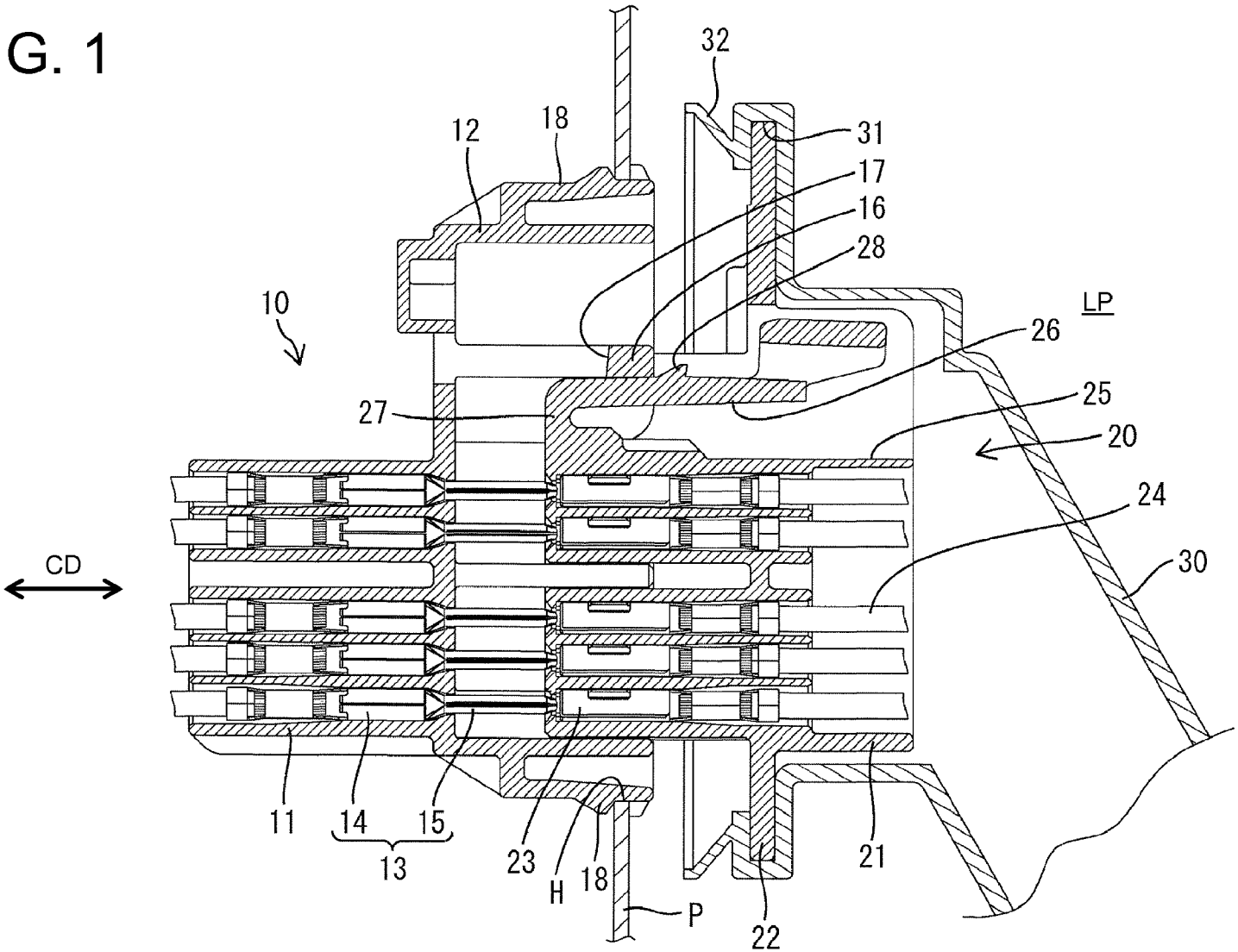
FIG. 1 is a section showing a state where a connecting operation of two housings is started.

A connector in accordance with the invention has a fixed housing identified generally by the numeral 10 in FIGS. 1 to 4. The fixed housing 10 is to be mounted on a panel P of e.g. an automotive door (not shown). A movable housing 20 is connectable with the fixed housing 10, and a grommet 30 is attached to the movable housing 20. In the following description, ends facing the mating housings 20, 10 are referred to as front ends concerning forward and backward directions of the respective housings 10, 20.

The fixed housing 10 is made unitarily of synthetic resin and has a terminal holding portion 11 and a substantially tubular fitting 12 that projects forward from the terminal holding portion 11. Male terminal fittings 13 have terminal main bodies 14 accommodated in the terminal holding portion 11 and tabs 15 at the leading ends of the male terminal fittings 13 project into the tubular fitting 12 from the front end surface of the terminal holding portion 11.

A plate-like lock 16 projects forward from the back end surface of the tubular fitting 12. A projecting direction of the lock 16 is substantially parallel with a connecting direction CD of the two housings 10, 20 and substantially at a right angle to the panel P. A lock hole 17 vertically penetrates the lock 16.

A resilient locking piece 18 is formed on the outer peripheral surface of the tubular fitting 12, and the fixed housing 10 is to be mounted on the panel P from the inner side of the door by engaging the resilient locking piece 18 with edge of a mount hole H of the panel P. A front end edge of the tubular fitting 12 is fit in the mount hole H and exposed to the outer side of the panel P when the fixed housing 10 is mounted.

The movable housing 20 is made unitarily of synthetic resin and includes a terminal accommodating portion 21 and a flange 22 that projects from the outer circumferential surface of the terminal accommodating portion 21 over substantially the entire periphery. Female terminal fittings 23 are accommodated in the terminal accommodating portion 21 and wires connected with the rear ends of the female terminal fittings 23 are drawn out backward from the rear end surface of the terminal accommodating portion 21.

An accommodation space 25 penetrates an upper part of the terminal accommodating portion 21 in forward and backward directions, and a lock arm 26 is accommodated in the accommodation space 25. The lock arm 26 is cantilevered backward from a support 27 on the front end of the terminal accommodating portion 21 and is resiliently displaceable down about the supporting 27 and toward the terminal accommodation portion 21 to an unlocking posture UP (see FIGS. 2 and 3). A backward extending direction of the lock arm 26 is substantially parallel with the connecting direction CD of the two housings 10, 20 when the lock arm 26 is undeformed and in a locking posture LP (see FIGS. 1 and 4). A lock projection 28 is formed on the upper surface of the lock arm 26.

The grommet 30 is made of a resilient material, such as rubber, and has a tubular shape. A fitting groove 31 is formed in the inner peripheral surface near a front end of the grommet 30. The grommet 30 is attached to the movable housing 20 by engaging the fitting groove 31 with the flange 22 from the outer side before the two housings 10, 20 are connected. The grommet 30 attached to the movable housing 20 extends substantially back while at least partly covering the rear end surface of the fixed housing 20. Wires 24 drawn out from the terminal accommodating portion 21 are arranged through the interior of the grommet 30.

A resilient sealing piece 32 is formed over substantially the entire periphery at an opening edge of the front end of the grommet 30 and is widened toward the front. The resilient sealing piece 32 is deformed resiliently and is held in fluid or liquid tight contact with the outer surface of the panel P when the two housings 10, 20 are connected properly, thereby displaying a waterproof or fluidproof performance. The resilient sealing piece 32 is held in contact with an area surrounding the mount hole H, thereby hindering the entrance of liquid or fluid into the mount hole H from the outer side of the panel P. In this way, connected parts of the two housings 10, 20 are made fluid or watertight.

The fixed housing 10 is mounted on the panel P and the grommet 30 is attached to the movable housing 20 before connecting the two housings 10, 20. In this state, the movable housing 20 is fit into the tubular fitting 12 from the outer side of the panel P. The lock projection 28 contacts the front end edge of the lock 16 when a connection stroke reaches a distance of more than about 0.5 mm (e.g. about 1 mm) after the start of the connecting operation, as shown in FIG. 1. The terminal fittings 13, 23 do not touch each other at this point of time. Thus, there is no connection resistance Ra (shown by dashed-dotted line in FIG. 5) resulting from the contact of the terminal fittings 13, 23. Further, the resilient sealing piece 32 of the grommet 30 also is not in contact with the panel P. Thus, there is no connection resistance Rb (shown by chain double-dashed line in FIG. 5) resulting from the deformation of the grommet 30 (see FIG. 5).

The connecting operation proceeds so that the lock projection 28 slides on the lower surface of the lock 16. Interference of the lock projection 28 and the lock 16 causes the lock arm 26 to deform resiliently toward the unlocking posture UP. During this time, a resilient restoring force of the lock arm 26 produces friction and generates a connection resistance Rc, as shown by the broken line in FIG. 5. The connection resistance Rc of the lock arm 26 becomes an operation force F (total connection resistance) necessary to connect the two housings 10, 20. The connection resistance Rc resulting from the resilient restoring force of the lock arm 26 varies slightly during connection, but preferably is kept at a substantially constant magnitude.

Figure 2:
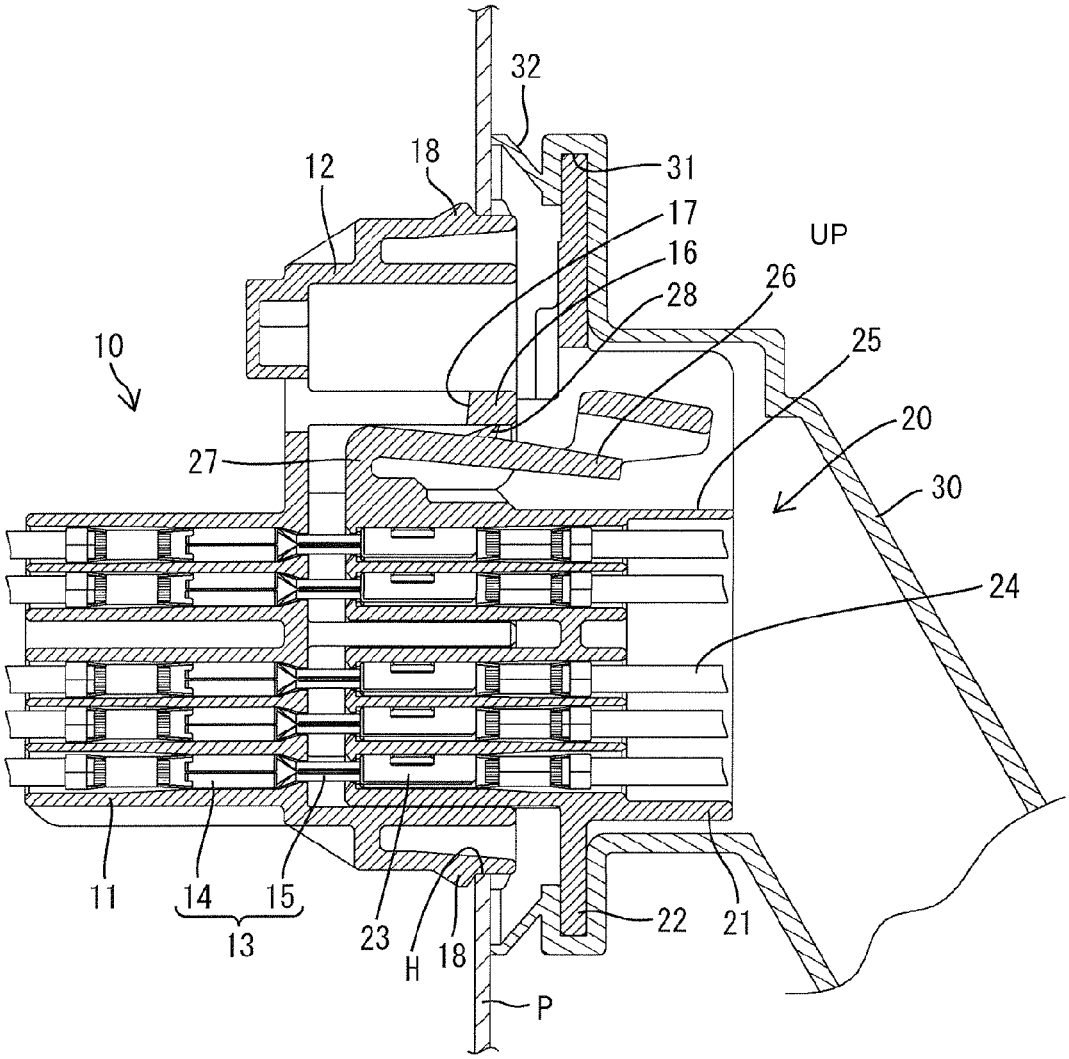
FIG. 2 is a section showing a state where a lock arm is resiliently deformed and terminal fittings start touching each other in the process of connecting the two housings.
Figure 3:
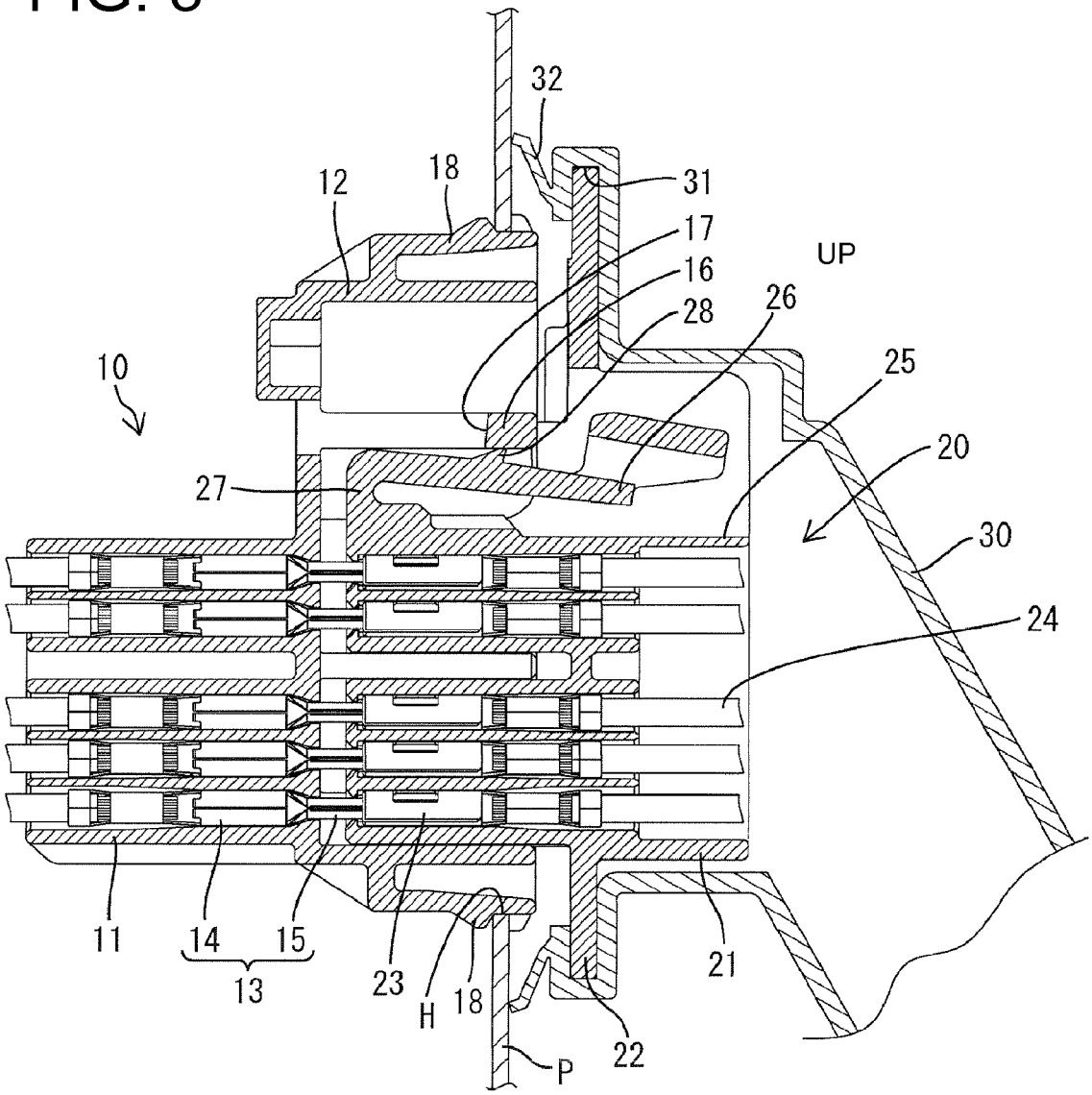
FIG. 3 is a section showing a state where the lock arm is resiliently deformed, the terminal fittings are in contact with each other and a grommet starts being resiliently deformed in the process of connecting the two housings.

The male and female terminal fittings 13 and 23 start touching each other when the connecting operation proceeds sufficiently far for the connection stroke to reach more than about 2 mm (e.g. about 4 mm), as shown in FIG. 2. The connection resistance Ra resulting from friction between both types of terminal fittings 13, 23 is produced as the connecting operation proceeds further. Accordingly, the operation force F necessary for the connecting operation thereafter is equal to the sum of the connection resistance Rc resulting from the resilient deformation of the lock arm 26 and the connection resistance Ra resulting from the contact between the terminal fittings 13, 23. The connection resistance Ra resulting from the contact between the terminal fittings 13, 23 increases suddenly in an initial stage after being produced, but comes to have a substantially constant magnitude after the connection stroke exceeds about 5 mm.

Figure 5:
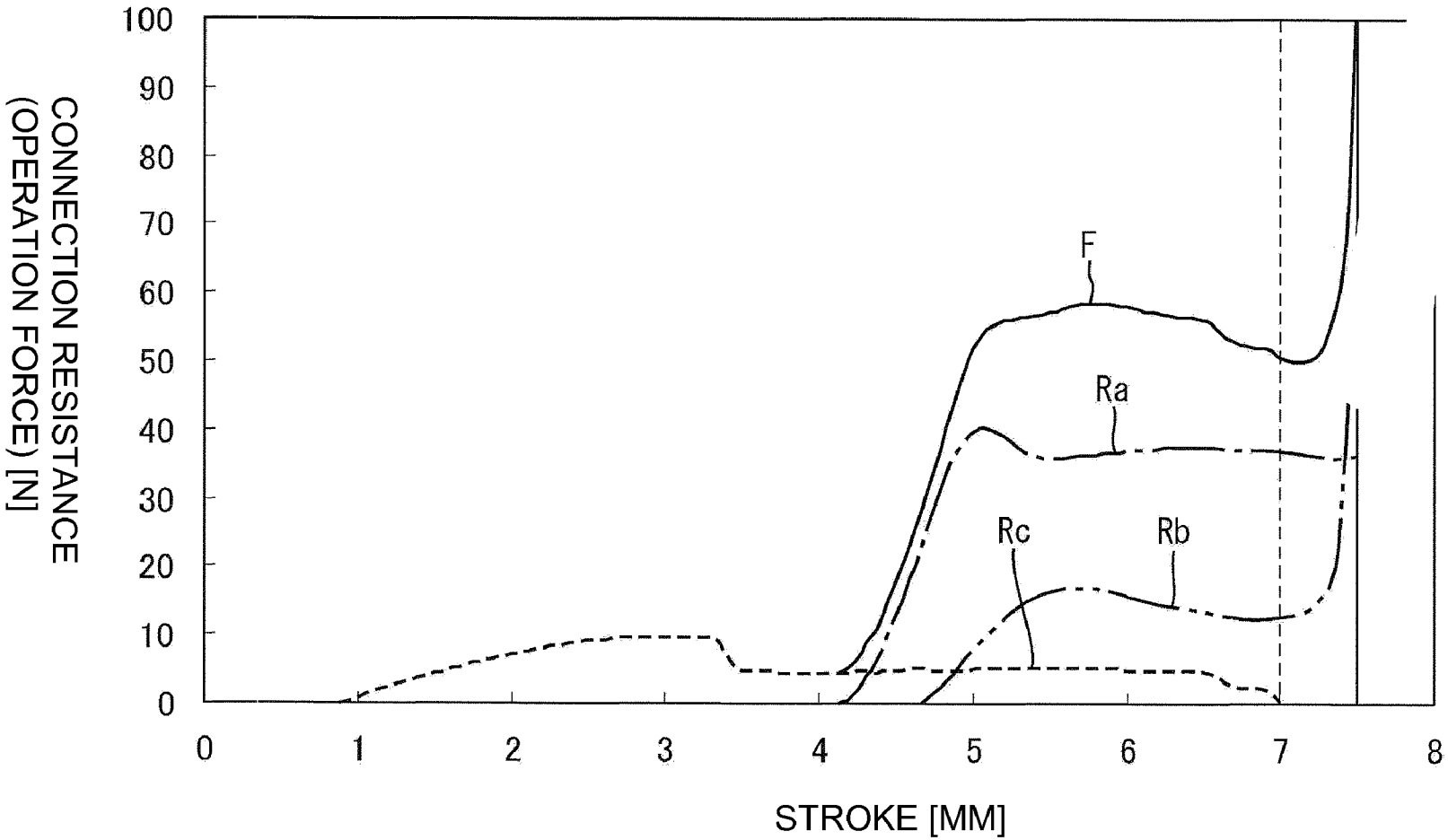
FIG. 5 is a graph showing connection resistances in the process of connecting the two housings.

The resilient sealing piece 32 starts being resiliently deformed by contact with the panel P when the connection stroke exceeds about 4.5 mm and the connection resistance Rb resulting from a resilient restoring force of the resilient sealing piece 32 is produced (see FIG. 5). Accordingly, the operation force F necessary for the connecting operation thereafter has a magnitude equal to the sum of the connection resistance Rc resulting from the resilient deformation of the lock arm 26, the connection resistance Ra resulting from the contact between the terminal fittings and the connection resistance Rb resulting from the resilient restoring force of the resilient sealing piece 32 (grommet 30). The connection resistance Rb resulting from the resilient restoring force of the grommet 30 suddenly increases in an initial stage after being produced, but undergoes a transition at a substantially constant magnitude with a tendency to gradually decrease when the connection stroke exceeds about 5.5 mm.

Figure 4:
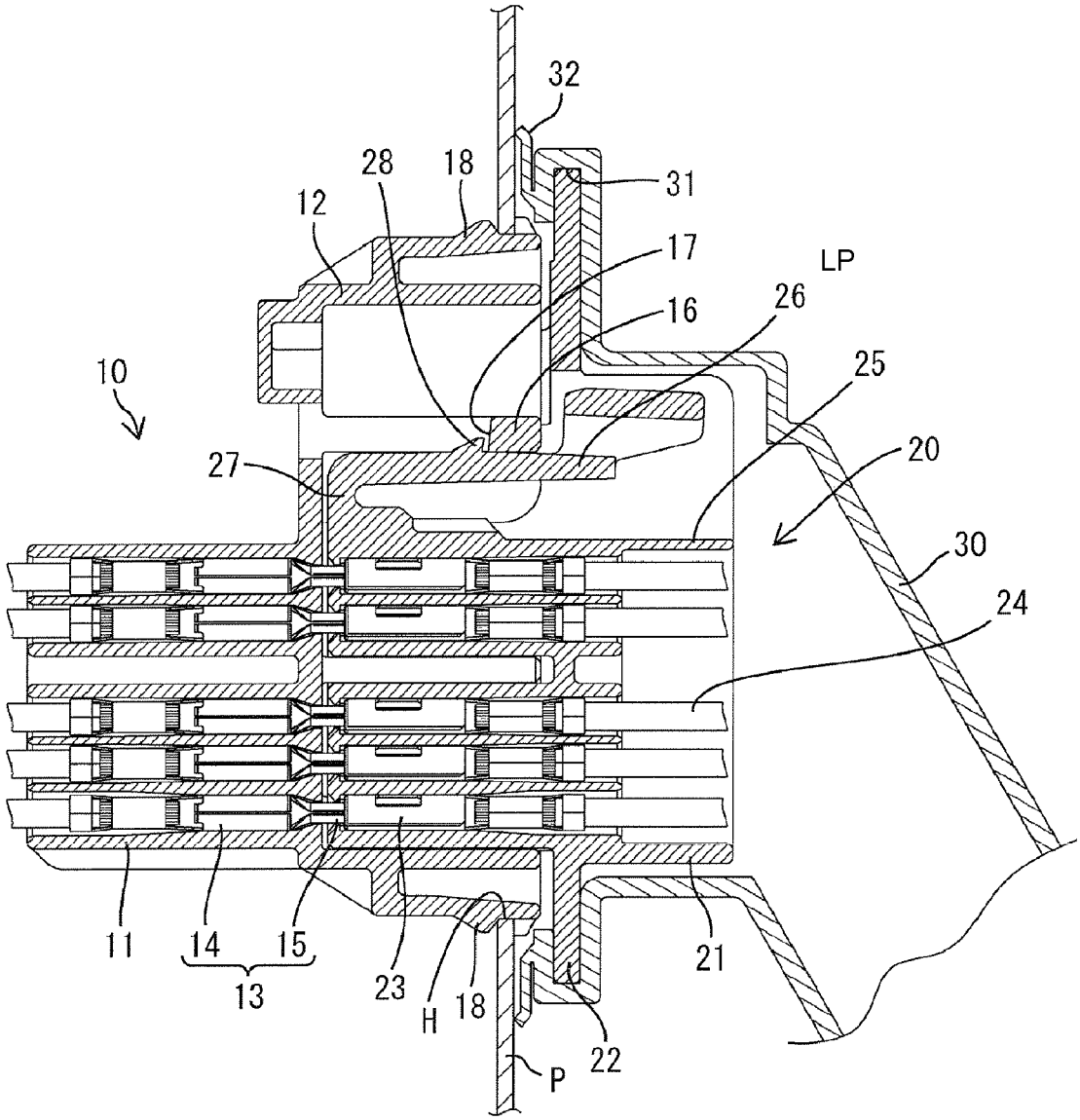
FIG. 4 is a section showing a state where the two housings are connected properly.

The lock projection 28 disengages from the lower surface of the lock 16 when the connection stroke reaches a value of more than about 6 mm (e.g. reaches about 7 mm) and the two housings 10, 20 reach a substantially properly connected state. The lock arm 26 then resiliently restores to the locking posture LP, as shown in FIG. 4. The lock projection 28 enters the lock hole 17 and engages the edge of the lock hole 17 when the lock arm 26 is restored. As a result, the two housings 10, 20 are locked together.

The connection resistance Rc resulting from the resilient restoring force of the lock arm 26 disappears after the lock arm 26 is restored. Thus, the operation force F necessary for the connecting operation becomes a force equal to the sum of the connection resistance Ra resulting from the contact between the terminal fittings 13, 23 and the connection resistance Rb resulting from the resilient restoring force of the grommet 30.

The magnitude of the connection resistance Rb resulting from the resilient restoring force of the grommet 30 is substantially constant during a period from immediately before the lock arm 26 is restored resiliently (e.g. connection stroke is about 6.5 mm) until the lock arm 26 is restored resiliently. Similarly, the connection resistance Ra resulting from the contact between the terminal fittings 13, 23 is substantially constant. Accordingly, the operation force F necessary for the connecting operation does not suddenly increase during the period from immediately before the lock arm 26 is restored resiliently until the lock arm 26 is restored resiliently.

A force of the grommet 30 for pressing the panel P becomes suddenly stronger when the lock arm 26 is restored resiliently (i.e. an amount of resilient deformation of the grommet 30 suddenly increases). Thus, the connection resistance Rb resulting from the resilient restoring force of the grommet 30 also suddenly increases. At this time, an operator can judge that the two housings 10, 20 have reached the properly connected state by feeling this sudden increase of the connection resistance Rb resulting from the resilient restoring force of the grommet 30.

The connection resistance Rb (operation force F) resulting from the resilient restoring force of the grommet 30 reaches a peak when the connection stroke reaches more than about 7 mm (e.g. about 7.5 mm). Thus, the operator cannot perform the connecting operation any further and the connecting operation is completed.

The properly connected state of the two housings 10, 20 is defined as follows. The two housings 10, 20 are connected properly if located in a range from a position where the lock arm 26 is restored resiliently to a position where the operation force F (connection resistance) reaches a peak (range where the connection stroke is from about 7 mm to about 7.5 mm in FIG. 5) in the process of connecting the two housings 10, 20.

According to this embodiment, in the process of connecting the two housings 10, 20, the connection resistance Rb resulting from the resilient restoring force of the grommet 30 held in contact with the panel P is substantially constant during the period immediately before the lock arm 26 is restored resiliently until the lock arm 26 is restored resiliently to lock the two housings 10, 20 into each other. The connection resistance Rb resulting from the resilient restoring force of the grommet 30 increases after the lock arm 26 is restored resiliently to effect locking.

In other words, in the process of connecting the two housings 10, 20, the operator feels an increase of the connection resistance Rb resulting from the resilient restoring force of the grommet 30 after the lock arm 26 is restored resiliently to engage with the lock 16 and the operation force F necessary for the connecting operation does not suddenly increase before the resilient restoring movement of the lock arm 26 is completed. Thus, the operator will not misjudge that the two housings 10, 20 have been connected properly before the lock arm 26 and the lock 16 are engaged even if the connecting operation is performed slowly so as not to place a burden on the operator. Therefore, the operator can complete the connecting operation until the lock arm 26 is restored resiliently to effect locking and can reliably properly connect the two housings 10, 20.

The invention is not limited to the above described and illustrated embodiment. For example, the following embodiments are also included in the technical scope of the present invention.

Although the lock arm is formed in the movable housing in the above embodiment, it may be formed in the fixed housing according to the present invention.

The lock projection formed on the lock arm engages the lock hole in the lock in the above embodiment. However, a lock projection formed on the lock may engage a lock hole formed in the lock arm according to the invention.

The movable housing is a female housing and the fixed housing is a male housing in the above-described embodiment. However, the movable housing may be a male housing and the fixed housing may be a female housing.

In the process of connecting the two housings, a timing at which the connection resistance resulting from the contact between the terminal fittings is produced and a magnitude of the variation of the connection resistance may vary those described above. These timing and magnitude variations can be changed in relation to a timing at which the connection resistance resulting from the resilient restoring force of the grommet is produced.

In the process of connecting the two housings, a timing at which the connection resistance resulting from the resilient restoring force of the grommet is produced and a magnitude of the variation of this connection resistance may be varied from those described above and can be changed in relation to the timing at which the connection resistance resulting from the contact between the terminal fittings, the resilient restoring movement of the lock arm and the like (e.g. the connection resistance resulting from the resilient restoring force of the grommet moderately increases before the lock arm is resiliently restored). Further, the changing ways of the connection stroke and/or the magnitude of the connection resistance are not limited to those described in the above embodiment. However, in any case, it is a premise that the resilient restoring force of the grommet suddenly increases after the lock arm is resiliently at least partly restored (more suddenly increases if the connection resistance resulting from the resilient restoring force of the grommet increases before the lock arm is resiliently at least partly restored).

What is claimed is:

1. A connector mounting structure for a panel and a connector, the connector including:

a fixed housing to be mounted on the panel, a lock formed on the fixed housing and terminal fittings mounted in the fixed housing;

a movable connector assembly including a movable housing configured for connection with the fixed housing, a resiliently deformable lock arm formed on the movable housing, a lock projection projecting from an upper surface of the lock arm, the lock projection being formed with a rear surface substantially normal to the lock arm and facing the grommet, and a sloped front surface opposite the rear surface, the lock projection being configured to engage the lock during a connecting operation, mating terminal fittings mounted in the movable housing and being configured for mating with the terminal fittings in the fixed housing and a grommet attached to the movable housing, wherein:

the lock arm is configured to be deformed resiliently by the lock beginning at a first stage of a connection when the sloped front surface of the lock projection contacts the lock of the fixed and movable housings, thereby producing a first connection resistance due to a resilient restoring force of the lock arm;

the terminal fittings are disposed to start engaging the mating terminal fittings beginning at a second stage of a connection of the fixed and movable housings after the beginning of the first stage, thereby producing a second connection resistance; and the grommet is configured to contact the panel beginning at a third stage of the connection of the fixed and movable housings after the beginning of the second stage, thereby producing a third connection resistance due to a resilient restoring force of the grommet.

2. The connector mounting structure of claim 1, wherein the lock arm further is configured to restore resiliently and lock to the lock during a fourth stage of the connection of the fixed and movable housings after the beginning of the third stage, thereby the terminating the first connection resistance.

3. The connector mounting structure of claim 2, wherein the third connection resistance resulting from the resilient restoring force of the grommet is substantially constant during a period from immediately before the lock arm is restored resiliently until the lock arm is restored resiliently.

4. The connector mounting structure of claim 1, wherein the third connection resistance resulting from the resilient restoring force of the grommet increases after the lock arm is restored resiliently to effect locking.

5. The connector mounting structure of claim 2, wherein the lock arm and the lock are configured so that the first connection resistance remains at a substantially constant magnitude from a time during the first stage of the connection of the fixed and movable housings when a peak between the front and rear surfaces of the lock projection contacts the lock of the fixed housing until the fourth stage of the connection of the fixed and movable housings.

6. The connector mounting structure of claim 2, wherein the terminal fittings and the mating terminal fittings are configured so that the second connection resistance remains substantially constant from the beginning of the second stage of the connection of the fixed and movable housings to the fourth stage of the connection of the fixed and movable housings.

* * * * *